US005713648A

United States Patent [19]

Geib et al.

[11] Patent Number: 5,713,648

[45] Date of Patent: Feb. 3, 1998

[54] APPARATUS FOR STORING AND DISPENSING MEDICATION

[75] Inventors: William J. Geib, E. Greenwich; Richard R. Mathieu, Cumberland; Raymond A. Young, Jr., N. Smithfield, all of R.I.

[73] Assignee: CVS H.C., Inc., Brooklyn Park, Minn.

[21] Appl. No.: 560,325

[22] Filed: Nov. 17, 1995

[51] Int. Cl.[6] ..... A47B 49/00

[52] U.S. Cl. ..... 312/249.2; 312/125; 312/135; 221/13

[58] Field of Search ..... 312/249.2, 125, 312/126, 135, 305, 209; 221/13

[56] References Cited

U.S. PATENT DOCUMENTS

| | | | |
|---|---|---|---|
| 444,216 | 1/1891 | Bodenhamer | 312/209 |
| 874,933 | 12/1907 | Bristow, Jr. | 211/77 |
| 1,908,797 | 2/1933 | Svalland | 312/305 |
| 2,882,114 | 4/1959 | Sease et al. | 312/279 |
| 3,834,725 | 9/1974 | Luoni | 312/125 X |
| 4,159,783 | 7/1979 | Crasnianski | 221/13 |
| 4,273,393 | 6/1981 | Foley et al. | 312/135 X |
| 4,519,522 | 5/1985 | McElwee | 221/13 |
| 4,531,789 | 7/1985 | Iemura et al. | 312/135 X |
| 4,549,664 | 10/1985 | Gowan et al. | 312/125 X |
| 4,697,856 | 10/1987 | Abraham | 312/305 |
| 4,738,495 | 4/1988 | Mitts | 312/305 |
| 4,753,340 | 6/1988 | Blakeman et al. | 206/44.11 |
| 5,456,530 | 10/1995 | Blaize | 312/305 X |
| 5,558,417 | 9/1996 | Termotto | 312/125 X |

*Primary Examiner*—Peter M. Cuomo
*Assistant Examiner*—Rodney B. White
*Attorney, Agent, or Firm*—Seyfarth, Shaw, Fairweather & Geraldson

[57] ABSTRACT

A pharmacy carousel comprising an open cylindrical frame having a plurality of independently rotatable discs, a tray on each disc on which bulk containers of medication may be stored, and a lockout assembly which prevents a tray from rotating while it is in use. In a preferred embodiment, the pharmacy carousel further comprises a motor assembly which permits each tray to rotate independently of the other trays.

11 Claims, 3 Drawing Sheets

APPARATUS FOR STORING AND DISPENSING MEDICATION

This invention relates to an apparatus for storing and dispensing medication and, more particularly, to a pharmacy carousel which may be used simultaneously by multiple users to fill drug prescriptions.

BACKGROUND OF THE INVENTION

In most pharmacies, bulk containers of medication are stored on wall-mounted shelves. To fill a prescription, the pharmacist must physically travel to the correct shelf location for the medication, remove the container of medication from the shelf and take it to a work area, dispense the proper amount of medication from the bulk container into a container to be given to the customer, travel back to the correct shelf location, and replace the medication on the shelf. This system wastes the pharmacist's time and energy in travel to and from shelf locations. In addition, because of the numerous medications which must be stored and dispensed, there is a significant possibility of misplacing the medication in the wrong shelf location. In a pharmacy employing two or more pharmacists simultaneously filling prescriptions, additional time and energy may be wasted by a pharmacist looking for a medication that is in use by another pharmacist.

It is, therefore, an object of the present invention to provide an apparatus for efficiently storing and dispensing medication.

It is also an object of the present invention to provide an apparatus which significantly reduces the possibility of medication being misplaced.

It is also an object of the present invention to provide an apparatus for efficiently storing and dispensing medication which can be used by multiple pharmacists simultaneously.

SUMMARY OF THE INVENTION

These objects and others are achieved by the pharmacy carousel of the present invention. The pharmacy carousel comprises an open cylindrical frame having a plurality of independently rotatable discs, a tray on each disc on which bulk containers of medication may be stored, and a lockout assembly which prevents each disc from rotating while it is in use. In a preferred embodiment, the pharmacy carousel further comprises a motor assembly which may be used to mechanically rotate a disc independently of the other discs.

Further objects, features, and advantages of the invention will become evident from a consideration of the following detailed description when taken in conjunction with the accompanying drawings and the appended claims.

BRIEF DESCRIPTION OF THE DRAWINGS

For the purpose of facilitating an understanding of the invention there is illustrated in the accompanying drawings a preferred embodiment thereof, from an inspection of which, when considered in connection with the following description, its construction and operation, and many of its advantages should be readily understood and appreciated.

DETAILED DESCRIPTION OF THE INVENTION

Figure 1:
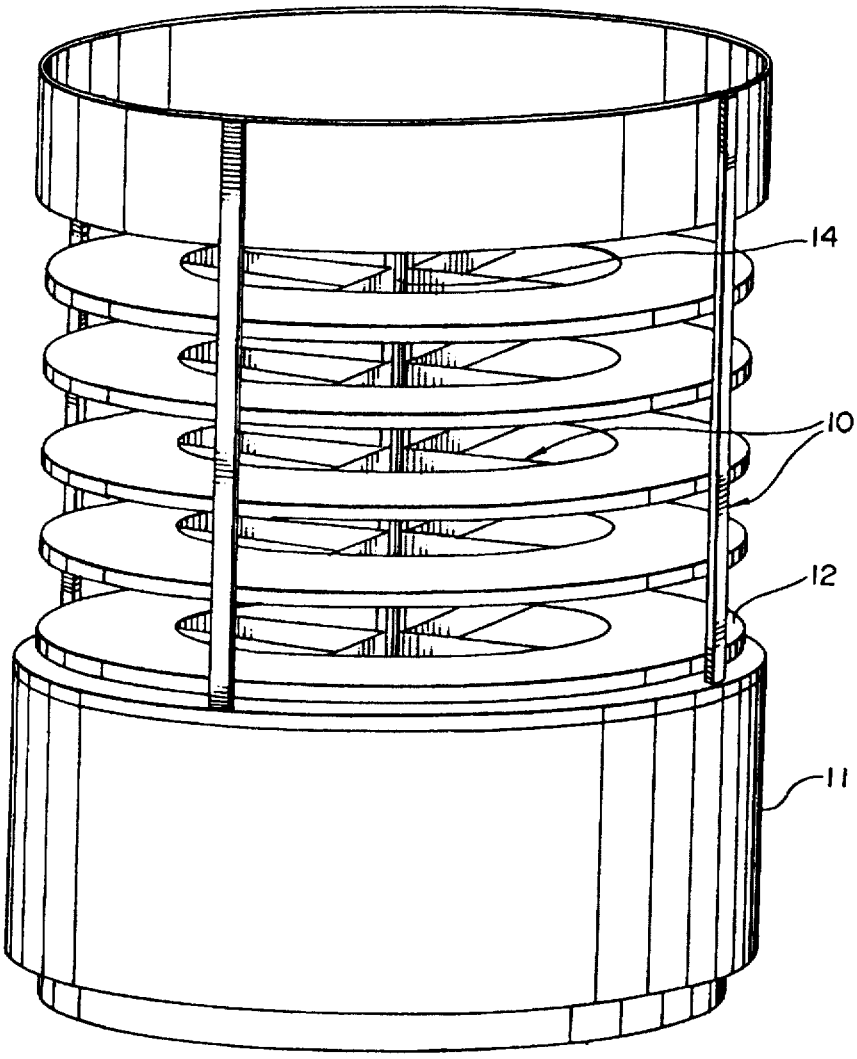
FIG. 1 is a perspective view of a pharmacy carousel according to the present invention.

As shown in FIG. 1, the pharmacy carousel of the present invention comprises a plurality of support shafts forming a frame 10, a base 11, a plurality of discs 12, and a central shaft 14. Additional discs 12 may be added to the pharmacy carousel by eliminating the base 11. On each disc 12 a tray 15 is installed, as shown in FIGS. 2–5.

Figure 2:
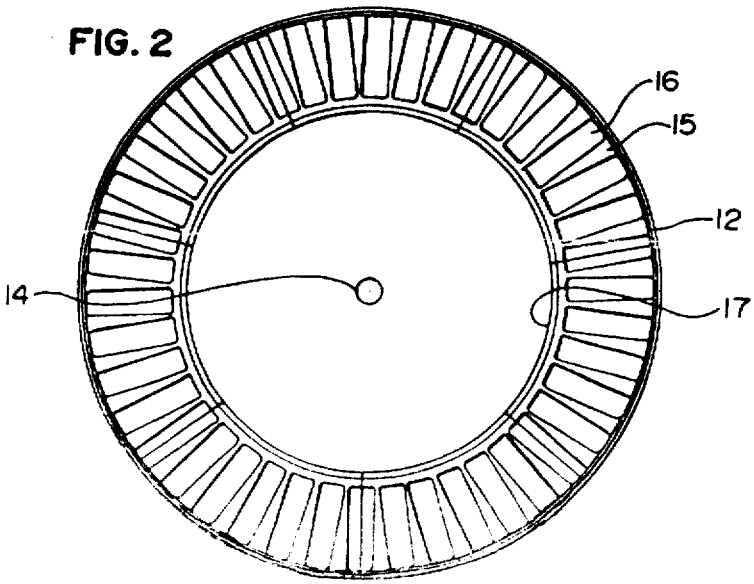
FIG. 2 is a plan view of one layer of a pharmacy carousel according to the present invention.

FIG. 2 shows one embodiment of a tray 15 The tray 15 has an inner cylindrical wall **15*a* at the back of the tray and an outer cylindrical wall 15*b* at the front of said tray (see FIGS. 4 and 5), each wall being coaxial with central shaft 14. A light blocking core 17 extending upwardly from said inner cylindrical wall and having holes 19 therein corresponding to the back of tray locations at which medication is to be stored surrounds the central shaft 14. The tray 15 may have a plurality of formed spaces 16, as shown in FIG. 2. The spaces 16 may be formed to receive medication containers, such as pill cassettes, as shown in FIG. 2, or they may be formed to receive bottles (not shown). Alternatively, the tray 15 may have a flat surface, rather than formed spaces, to allow greater flexibility in the placement of medication containers on the tray 15**.

Figure 3:
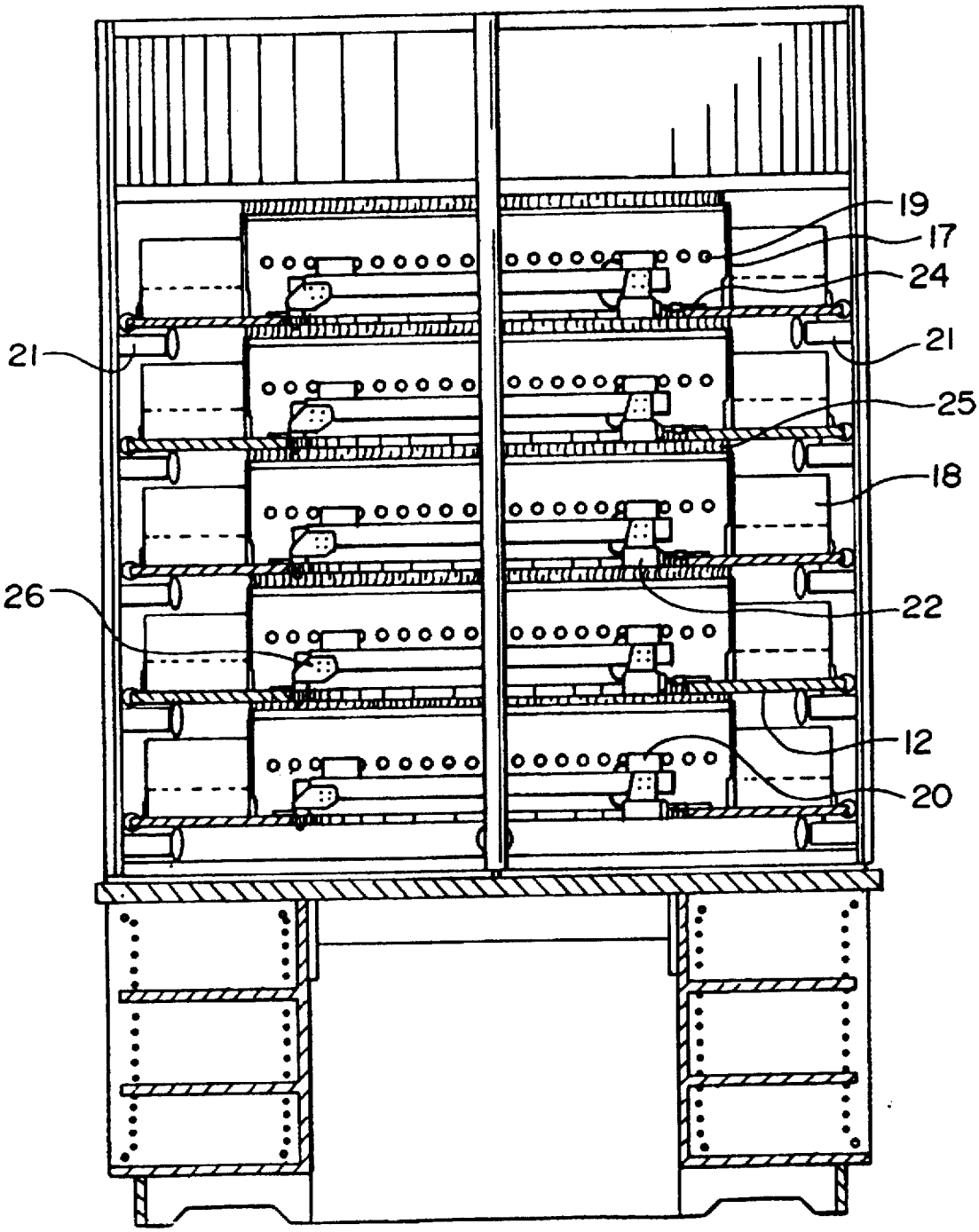
FIG. 3 is a sectional view of the pharmacy carousel of the present invention.
Figure 4:
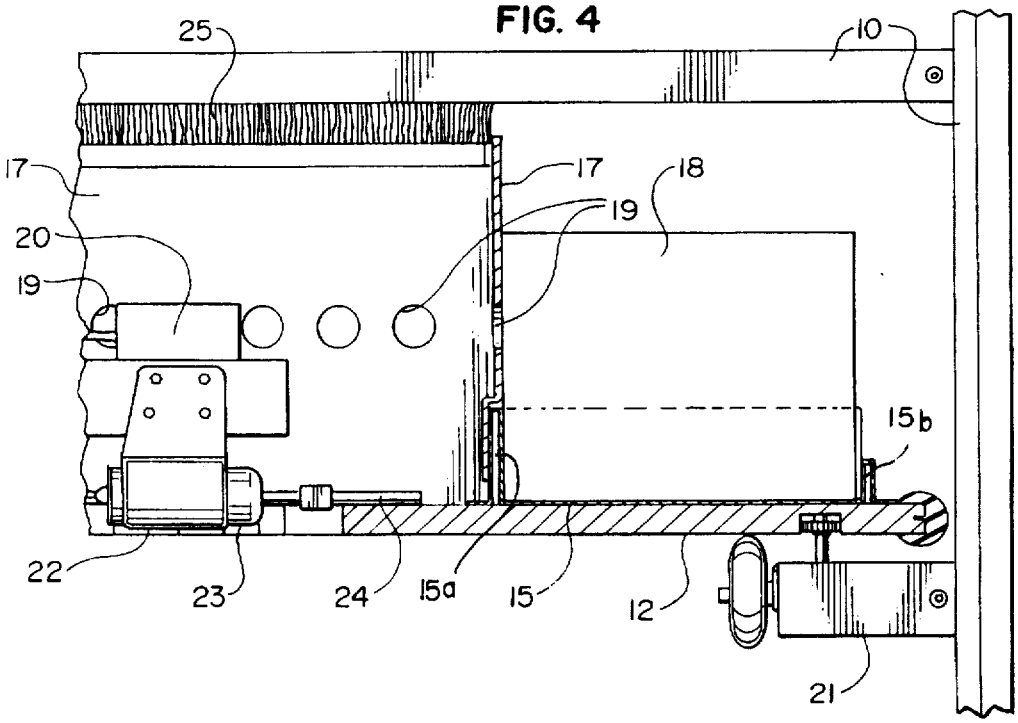
FIG. 4 is a sectional view of the lockout and roller assembly of the present invention.
Figure 5:
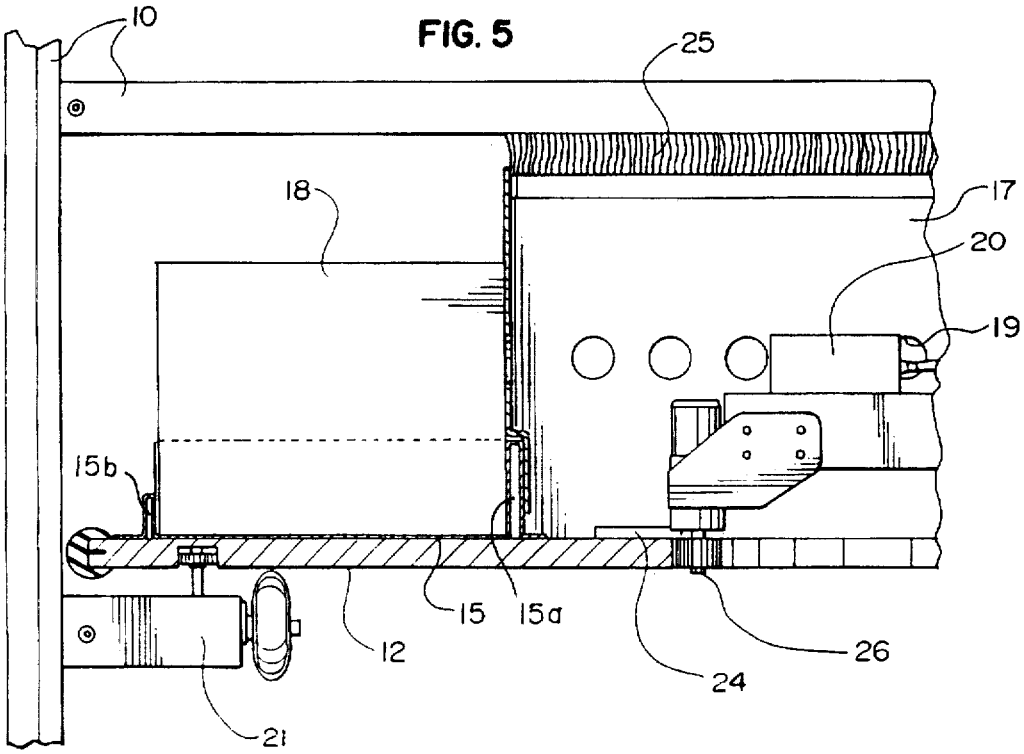
FIG. 5 is a sectional view of the motor and roller assembly of the present invention.

The discs 12 are mounted at either end upon a roller assembly 21, as shown in FIGS. 3, 4 and 5. The disc 12 and tray 15 ride on roller assemblies 21 such that the disc 12 and tray 15 may be rotated together about central shaft 14. A medication container 18 is placed in the area of the tray 15 formed to receive it. Thus, a pharmacist located at a prescription filling workstation may rotate the discs 12 to bring the needed medication to a location facing his workstation rather than physically traveling to the medication storage location. When a container 18 is removed, a light hole 19 is uncovered, and a photoelectric sensor 20 detects the light and senses that the container 18 has been removed. Continuous brushes 25 are positioned between the discs 12 to block light to the photoelectric sensor 20 from any sources other than the light holes 19.

Each disc 12 is provided with a lockout device 22. The lockout device 22 may be activated manually or automatically. In a preferred embodiment, the lockout device 22 is automatically activated to insure that a disc 12 does not rotate when the photoelectric sensor 20 detects that a container 18 has been removed from that disc 12. As shown in FIG. 4, a piston 23 extends to engage a flywheel 24 on tray 15 so as to prevent the tray 15 from moving when the photoelectric sensor 20 detects that a container 18 has been removed. This lock-out feature insures safety and quality control by encouraging the return of the container 18 to the same location so that particular medications are always located in the same place.

The pharmacy carousel described may be simultaneously used by more than one pharmacist. For example, a series of pharmacist workstations may be positioned about the perimeter of the carousel. Each pharmacist may locate the medication that he needs to fill a prescription, and rotate the tray 15 on which that medication is located to a location directly facing his workstation. Because each tray 15 rotates and may be locked out independently, the tray 15 from which the medication container was removed will not rotate when the lock-out device is activated for that tray, but the other trays will be able to rotate. Thus, other pharmacists working at other workstations may simultaneously fill prescriptions from other trays 15.

As shown in FIG. 5, a motor assembly 26 may be used to rotate the disc 12 and tray 15. The motor assembly 26 is particularly useful in high volume operations, where electronic controls may be used to quickly and accurately rotate the discs 12 to provide a pharmacist with the required medication container. In a preferred embodiment, separate electronic controls are provided for each pharmacist separately to rotate the discs 15 containing desired medication containers to locations facing each pharmacist's workstation.

If desired, one or more discs 12 may be motorized to spin continuously, for example, to transport a filled prescription from the pharmacist who filled the prescription to an employee who will deliver the filled prescription to the customer. In a preferred embodiment, a computer may be used to locate a desired medication and to direct the motor assembly 26 of the disc 12 on which the desired medication is located to rotate the disc 12 to the position at which the pharmacist is located.

The invention has been described above in an illustrative manner and it is to be understood that terminology which has been used is intended to be in the nature of description rather than of limitation. Obviously, many modifications and variations of the present invention are possible in light of the above teachings. It is therefore to be understood that within the scope of the appended claims, the invention may be practiced otherwise than as specifically described.

What is claimed is:

1. A pharmacy carousel comprising:

a frame, a plurality of discs for carrying containers of medication rotatably mounted on said frame for rotation independently of one another, and a stop mechanism carried by said frame and selectively engageable with said discs to mechanically prevent any rotation of an engaged disc.

2. The pharmacy carousel of claim 1, wherein said stop mechanism includes a plurality of stop devices respectively engageable with said discs for respectively mechanically preventing rotation thereof.

3. The pharmacy carousel of claim 1, and further comprising control means for controlling rotation of said discs.

4. A pharmacy carousel comprising:

a frame, a plurality of discs rotatably mounted on said frame for carrying containers of medication, a motor mechanism including a plurality of motors respectively coupled to said discs for respectively effecting rotation thereof, and a stop mechanism carried by said frame and selectively engageable with said discs to mechanically prevent rotation of said discs.

5. A pharmacy carousel comprising:

a frame, at least one disc rotatably mounted on said frame for carrying containers of medication, an optically actuated stop mechanism carried by said frame engageable with said at least one disc and having a normal condition accommodating rotation of said at least one disc and a stop condition preventing rotation of said at least one disc, said stop mechanism including a sensor responsive to ambient light for actuating the stop mechanism to its stop condition, and a tray disposed on said at least one disc for carrying the containers of medication, said tray having a plurality of apertures therein normally blocked by the presence of containers on said tray and responsive to removal of a container for admitting ambient light to said sensor.

6. The pharmacy carousel of claim 5, wherein said tray is annular in shape and has an inner cylindrical wall through which said apertures are formed, and further comprising a light blocking means cooperating with said inner cylindrical wall for preventing passage of light through the apertures therein.

7. The pharmacy carousel of claim 5, and further comprising a plurality of discs rotatably mounted on said frame.

8. The pharmacy carousel of claim 7, wherein said stop mechanism includes a plurality of stop devices respectively engageable with said discs for respectively preventing rotation thereof.

9. A pharmacy carousel comprising:

a frame, at least one disc rotatably mounted on said frame for carrying containers of medication, a stop mechanism carried by said frame and operable between a normal condition accommodating rotation of said at least one disc and a stop condition for preventing rotation of said at least one disc, and a lockout mechanism including a sensor responsive to removal of a container of medication from said at least one disc for actuating said stop mechanism to the stop condition thereof.

10. The pharmacy carousel of claim 9, wherein said sensor is a photoelectric sensor.

11. The pharmacy carousel of claim 9, and further comprising a plurality of discs rotatably mounted on said frame, said stop mechanism including a plurality of stop devices respectively associated with said discs for respectively preventing rotation thereof.

* * * * *